US006233964B1

(12) United States Patent
Ethington et al.

(10) Patent No.: US 6,233,964 B1
(45) Date of Patent: May 22, 2001

(54) LOW PROFILE ICE MAKER

(75) Inventors: Thomas E. Ethington, Mason City, IA (US); Donald G. Pannhoff, Marshfield, WI (US); Minjun Huang, Mason City, IA (US); Qiao Lu, Louisville, KY (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/649,362

(22) Filed: Aug. 28, 2000

Related U.S. Application Data

(63) Continuation of application No. 09/312,337, filed on May 14, 1999, now Pat. No. 6,109,043.
(60) Provisional application No. 60/085,638, filed on May 15, 1998.

(51) Int. Cl.[7] ..... F25C 5/18
(52) U.S. Cl. ..... 62/344; 312/406
(58) Field of Search ..... 62/344; 312/401, 312/406

(56) References Cited

U.S. PATENT DOCUMENTS

| | | | | |
|---|---|---|---|---|
| 4,180,297 | * | 12/1979 | Abrams | 312/406 |
| 4,706,466 | * | 11/1987 | Yingst et al. | 62/344 |
| 4,715,512 | * | 12/1987 | Buchser | 312/406 |
| 5,131,234 | * | 7/1992 | Furukawa et al. | 62/344 |
| 5,245,841 | * | 9/1993 | Paul et al. | 62/344 |
| 5,787,724 | * | 8/1998 | Pohl et al. | 312/401 |

* cited by examiner

*Primary Examiner*—William E. Tapolcai

(74) *Attorney, Agent, or Firm*—Sten Erik Hakanson

(57) ABSTRACT

The present invention comprises a low height ice maker designed primarily for use in under counter applications. An ice retaining bin includes a top end opening covered in part by a top panel and the remaining part by an ice access door. The bin is secured to a base, the base retaining certain components of a refrigeration system including; a condenser, a compressor, an expansion valve and a hot gas defrost valve. The base also retains a water dump valve, the electronic control for the ice maker and the condenser fan. When the bin is secured to the base, front and rear access areas are defined which areas can be opened by removing releasably securable panels. The control electronics, the condenser fan and high and low side service valves are positioned adjacent the front access. The expansion valve, hot gas defrost valve and the dump valve are positioned adjacent the rear access. An ice cube forming evaporator assembly is secured to an interior surface of the bin. The assembly includes a frame, and secured thereto; an ice forming evaporator, a water distribution tube, a water tray, a re-circulating water pump, a float operated water valve, and an ice drop detector. The water distribution tube, the water pump, the float valve and the ice detector are secured to the assembly frame with hand operable quick releasing means, such as wing nuts and the like. The ice maker herein provides for ease of serviceability whereby, after removal of the ice maker from underneath a counter, the access panels can be removed revealing the commonly serviceable components. The present invention also includes a control having programmed routines for helping to differentiate between transient failures to make ice that are not the result of mechanical failure of any of the components of the ice maker and those that are the result of an ice maker component failure.

2 Claims, 13 Drawing Sheets

10
16
18
12
28
28
66a 10
20
27
14
12
54c
28
28
66

140
MONITOR
142
EVAP. BELOW -25°F ?
NO
YES
144
SHUT DOWN
146
HAS 30 MIN. ELAPSED ?
NO
YES
150
ATTEMPT RESTART
152
EVAP. TEMP. BELOW -25°F ?
NO
YES
154
SHUT DOWN
HAS 2ND 30 MIN ELAPSED ?
NO
YES
ATTEMPT RESTART
NO
159
EVAP. TEMP. BELOW -25°F ?
YES
160
PERMANENT SHUT DOWN

LOW PROFILE ICE MAKER

This application is a continuation of Ser. No. 09/312,337 May 14, 1999, now U.S. Pat. No. 6,109,043, which claims benefit of Ser. No. 60/085,638 May 15, 1998.

BACKGROUND OF THE INVENTION

1. Field of the Invention

The present application relates to ice making machines and specifically to ice making machines that can be installed beneath a standard height counter top.

2. Background

Ice making machines are well known in the art and typically include an ice cube making mechanism located in an insulated bin for retaining a volume of ice cubes produced thereby. Ice makers designed for installation below the level of a countertop are also known. The below countertop positioning has the advantages of not taking up valuable countertop space and not blocking vision of a particular area. A problem with ice makers positioned beneath a counter top concerns the ease of serviceability thereof. The refrigeration components, such as, the compressor and condenser are required to be located beneath the bin. Thus, removal or servicing of such components requires that the ice maker be removed from underneath the counter and that the bin then be removed. Various strategies have been proposed to facilitate this type of servicing requirement. However, there remains a need to provide for ease of serviceability in under counter ice machines in a manner that the ice maker can also be relatively low in cost.

A further problem frequently encountered in ice makers of all types is the need for service calls. Oftentimes a service call results where the machine fails to operate to produce ice because of some transient effect but not because there is anything mechanically wrong with its components. Thus, for example, the condenser temperature can become too high because a vent path has become inadvertently but temporarily blocked. If the machine goes into permanent shut down, a service person will need to make the call only to find that the machine starts to run normally when reset because the object blocking normal cooling air flow has been removed. Many such situations occur for which a service call would not be required. Accordingly, it would be desirable to have a control for an ice making machine that could reduce the number of service calls required as the result of transient problems not resulting from actual mechanical problems with the ice maker.

SUMMARY OF THE INVENTION

The present invention comprises a low height ice maker designed primarily for use in under counter applications. An ice retaining bin includes a top end opening covered in part by a top panel and the remaining part by an ice access door. The access door is retained at an angle in its closed position, and can be slid underneath the top panel in a horizontal orientation in its open position. The access panel can be removed by releasable retaining means, such as screws or the like. The bin is secured to a base, the base retaining certain components of a refrigeration system including; a condenser, a compressor, an expansion valve and a hot gas defrost valve. The base also retains a water dump valve, the electronic control for the ice maker and the condenser fan. When the bin is secured to the base, front and rear access areas are defined which areas can be opened by removing releasably securable panels. The control electronics and the condenser fan are positioned adjacent the front access. The expansion valve, hot gas defrost valve and the dump valve are positioned adjacent the rear access.

An ice cube forming evaporator assembly is secured to an interior surface of the bin. The assembly includes a frame, and secured thereto; an ice forming evaporator, a water distribution tube, a water tray, a re-circulating water pump, a float operated water valve, and an ice drop detector. The water distribution tube, the water pump, the float valve and the ice detector are secured to the assembly frame with hand operable quick releasing means, such as wing nuts and the like.

The bin includes a vertical recess area along a back side thereof. A pair of refrigerant lines, low and high pressure, extend within the vertical recess between the evaporator and the compressor and condenser. A slot in the bin back side within the vertical recess permits connection of the two refrigerant lines to the evaporator positioned within the bin interior.

It can be appreciated by those of skill that the ice maker herein provides for ease of serviceability whereby, after removal of the ice maker from underneath a counter, the access panels can be removed from the front and rear access areas. At that point, all the refrigeration components can be accessed for replacement with the exception of the compressor and condenser. The evaporator assembly can also be easily reached by opening the access door and/or by also removing the top panel. All the major components thereof can also be accessed or removed, generally without the need for hand tools. Thus, the present invention provides for ease of serviceability without the need for removal of the bin from the base. However, the bin can be easily removed from the base for replacement of the compressor or condenser.

In operation, the ice maker herein works in the conventional manner wherein the refrigeration system provides for cooling of the evaporator. Ice is formed thereon as water is pumped by the re-circulating pump to flow from the water distribution tube over the surface thereof A temperature sensor in the evaporator suction line provides for signaling the electronic control that the ice is of sufficient thickness to harvest. The control then operates the hot gas defrost valve to route high pressure refrigerant to the evaporator to slightly melt the ice so that it can fall from the evaporator into the ice retaining area within the bin. The ice drop sensor includes a small flange that is positioned adjacent the surface of the evaporator. As the ice falls it hits the flange which causes a magnet attached thereto to move away from a proximity switch. The proximity switch signals the control that ice has been successfully harvested and a further ice making cycle can be initiated. In addition to this standard mode of operation, the control of the present invention also includes programmed routines for helping to differentiate between transient failures to make ice that are not the result of mechanical failure of any of the components of the ice maker and those that are the result of an component failure.

DESCRIPTION OF THE DRAWINGS

A better understanding of the structure, function, operation and advantages of the present invention can be had by referring to the following detailed description which refers to the following drawing figures, wherein.

DETAILED DESCRIPTION OF THE PREFERRED EMBODIMENT

Figure 1:
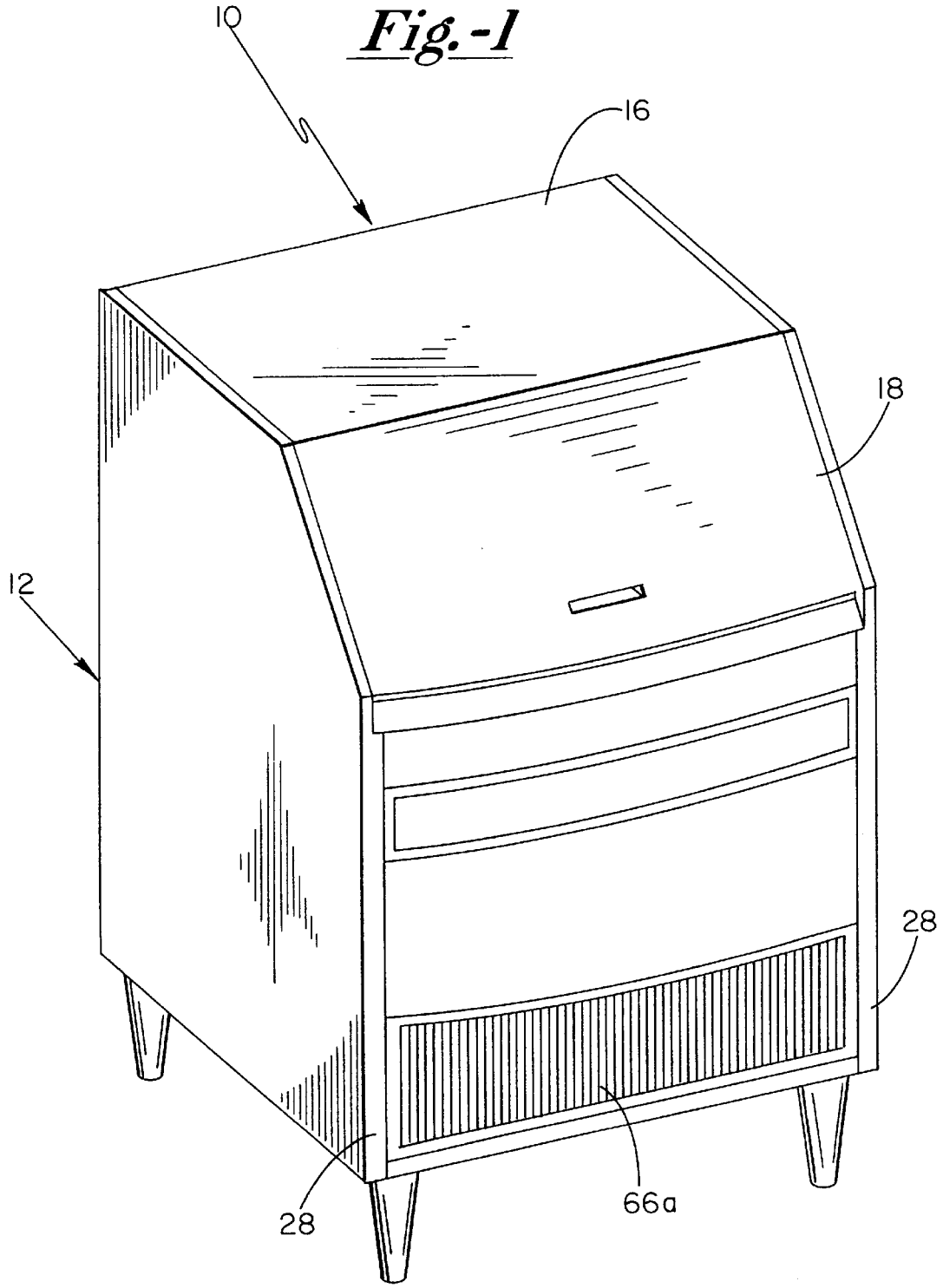
FIG. 1 shows a perspective view of the present invention.

The ice maker of the present invention is seen in FIGS. 1–4, and referred to generally by the numeral 10. Ice maker 10 includes a unitary molded bin structure 12 having an open end 14 and an interior area 15. End 14 includes a top panel 16 secured thereto by screws or other suitable quick releasing means. A door 18 is slideably mounted to bin 12 and can be moved to an open position extending horizontally beneath panel 16. Bin 12 includes a recess area 20 extending along the length of a back side 22 thereof. The area 20 is defined by a wall 24, integral to bin 12, and a protective plate 26 releasably secured to back side 22. A slot 27 extends partially along the length of recess area 20 through back side 22 into area 15. Bin 12 also includes two leg portions 28.

Figure 5:
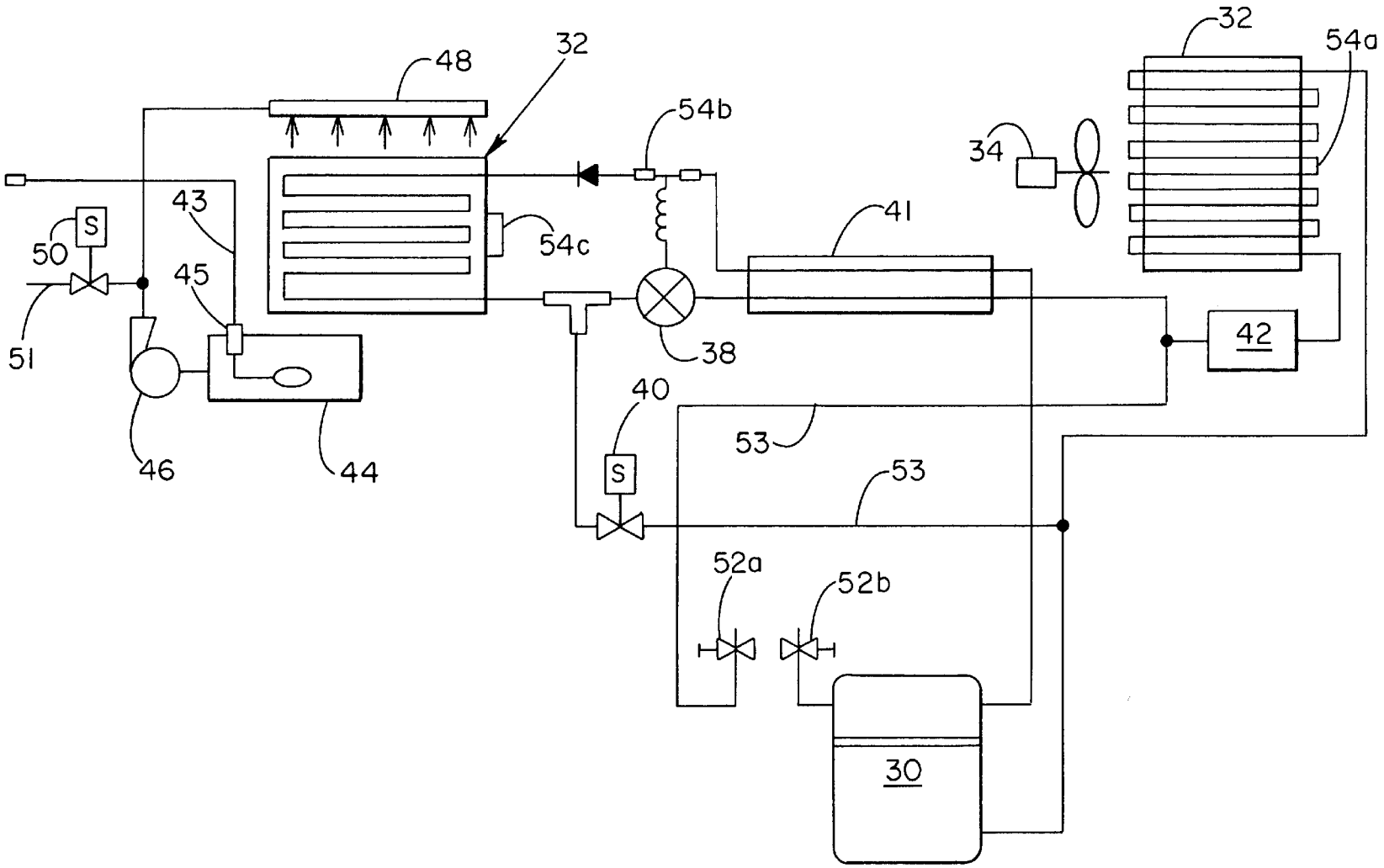
FIG. 5 shows a schematic diagram of the refrigeration and water flow systems of the present invention.
Figure 16:
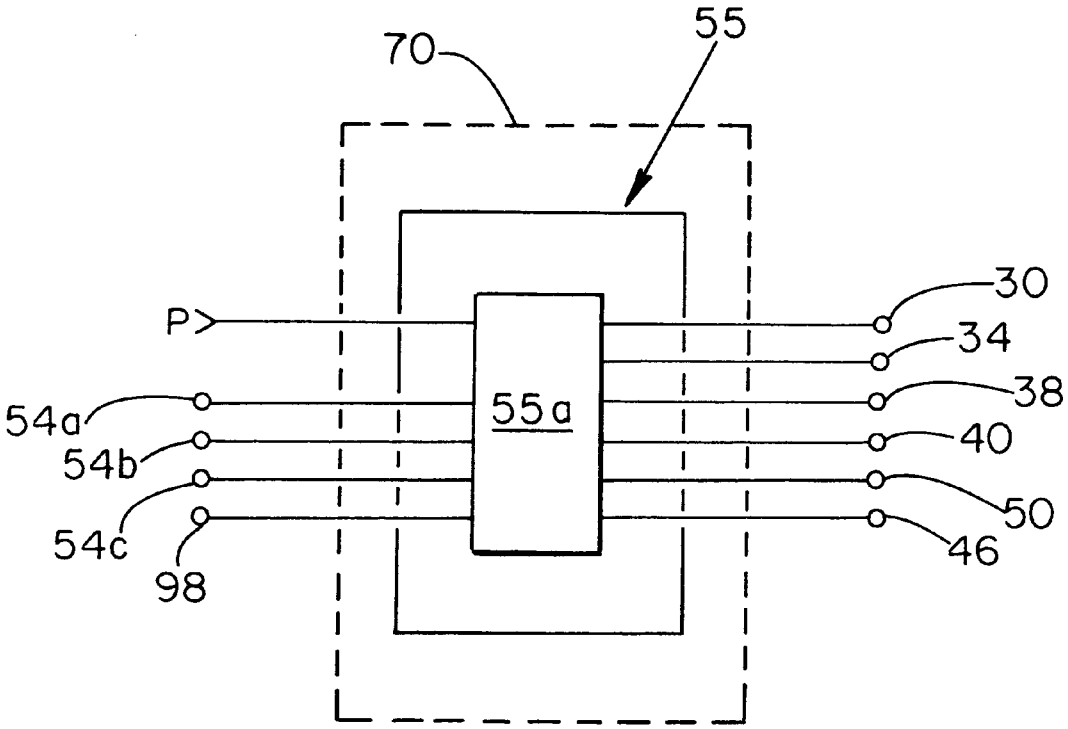
FIG. 16 shows a schematic view of the control of the present invention.

As seen in the schematic of FIG. 5, the present invention includes a refrigeration system including, a compressor 30, a condenser 32 and associated fan 34, an evaporator 36, an expansion valve 38, and a hot gas defrost valve 40. Also included are a heat exchanger 41 and a filter/drier 42. A water system includes an inlet water line 43 and a float operated inlet valve 45 connected to a source of potable water and positioned within a water collection tray 44. A water pump 46 supplies water, over a line 47, to a water distribution tube 48 positioned above evaporator 36. A dump valve 50 provides for draining of water through an outlet line 51 from tray 44 to a suitable drain. High and low side service valves 52*a* and 52*b* respectively, provide for service access to the refrigerant flowing in the various refrigerant lines 53. A high side temperature sensor 54*a* and a low side temperature sensor 54*b* provide for temperature sensing thereof. Temperature sensor 54*b* is also used to signal when it time to harvest the ice. A temperature sensor 54*c* is used to sense when the ice retaining area of bin 12 is full. As is known in the art, when the ice fills to the level of sensor 54*c*, the cooling thereof indicates a bin full condition. Thus, when the bin is full, no more ice is needed and the control herein stops any further ice making cycles until sensor 54*c* warms and thereby indicates As seen by also referring to the schematic of FIG. 16, the present invention utilizes an electronic control 55 having a microprocessor 55*a*. Inputs to microprocessor 55*a* include temperature sensors 54*a*, 54*b* and 54*c*, a power input P and a proximity switch 98, discussed in greater detail below. Microprocessor 55*a* controls the operation of compressor 30, fan 34, an valves 38, 40 and 50 and pump 46.

Figure 2:
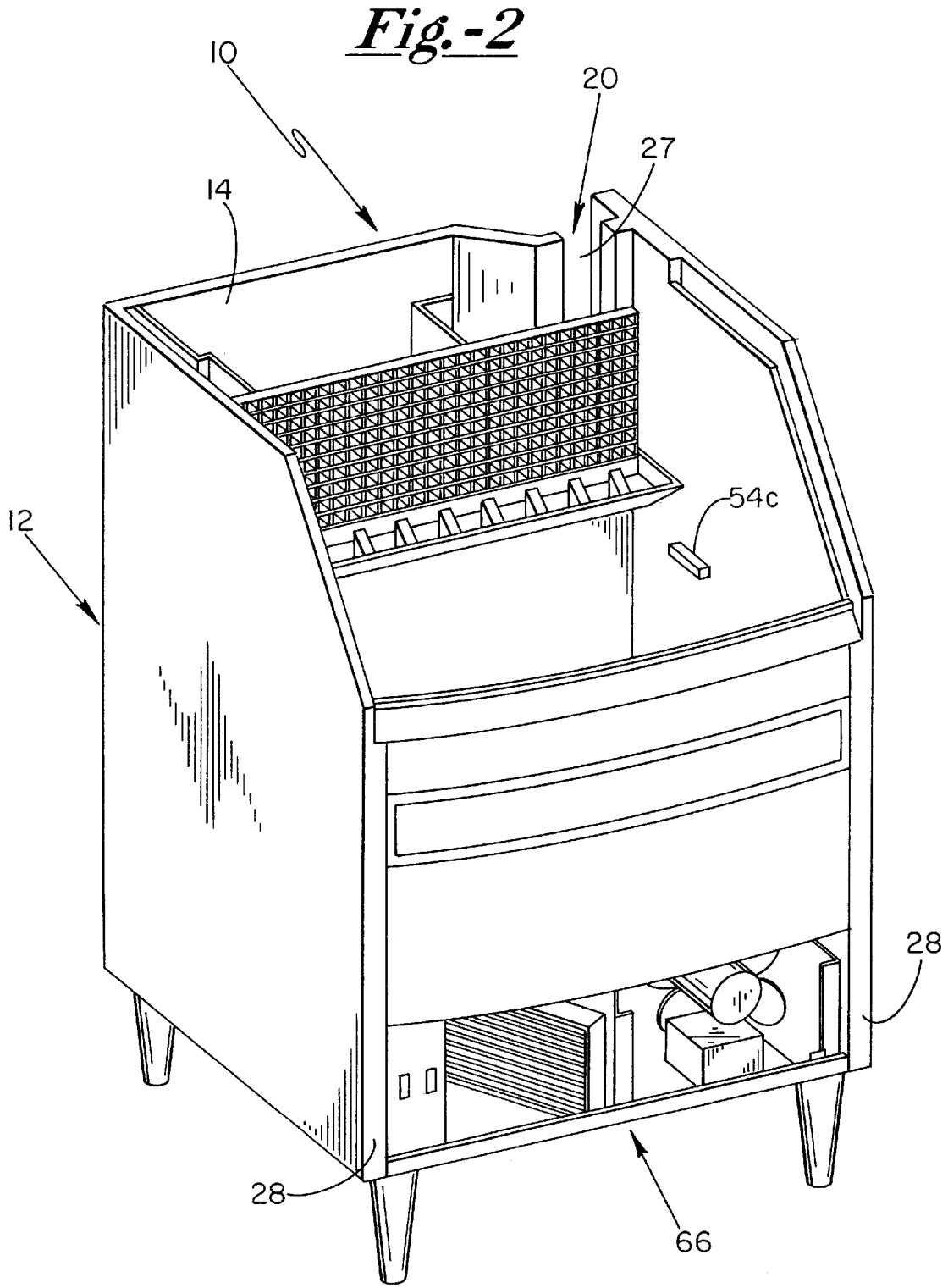
FIG. 2 shows a further perspective view of the present invention with the top panel, front access panel and door removed.
Figure 3:
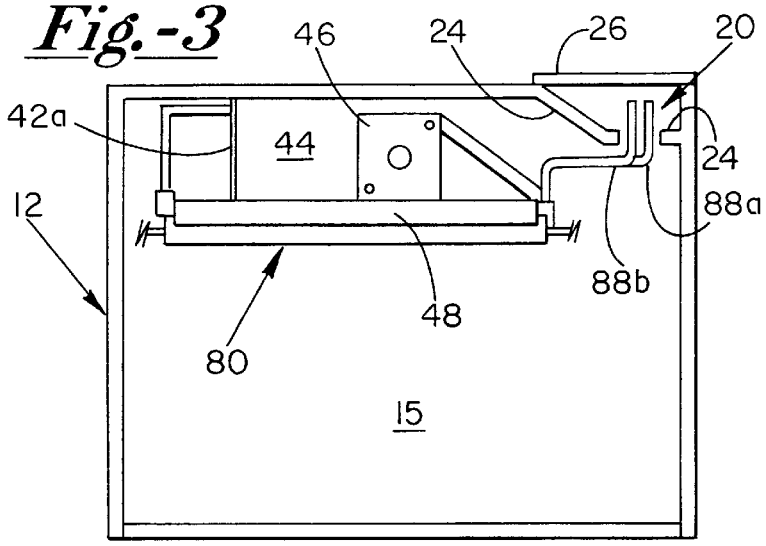
FIG. 3 shows a top plan view of the bin of the present invention.
Figure 4:
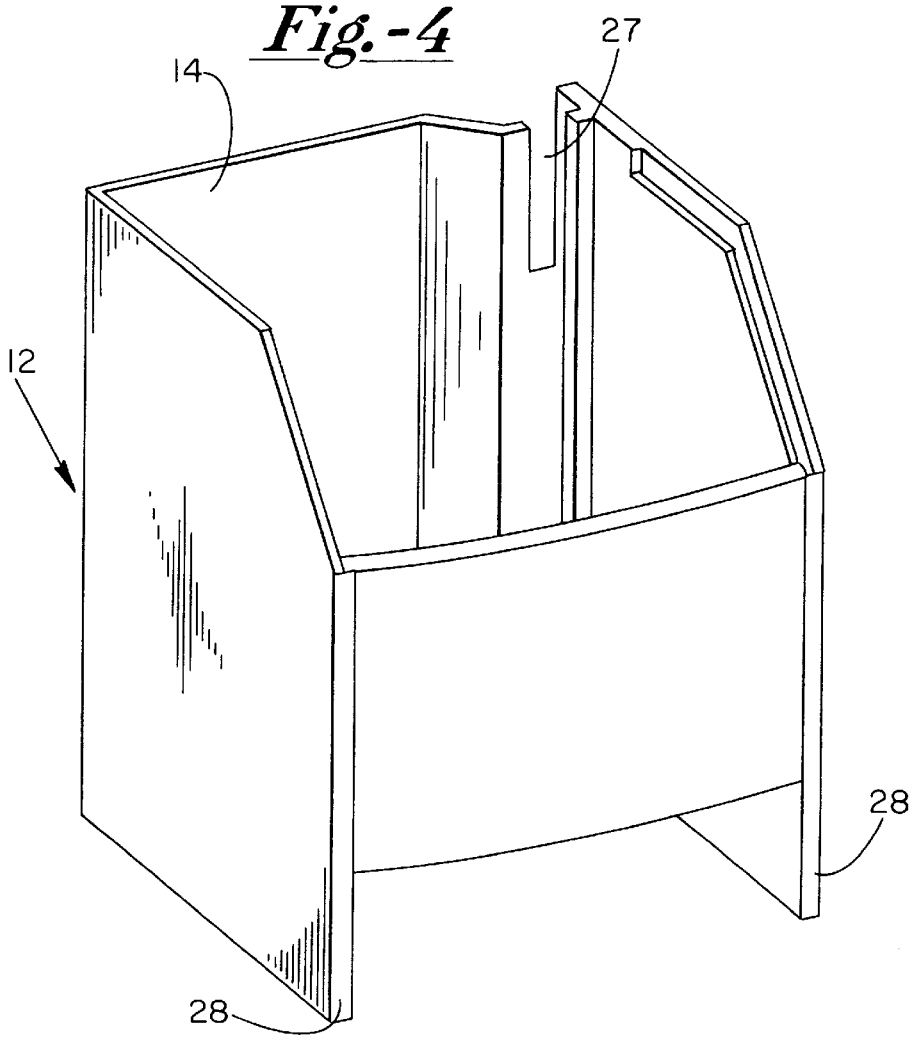
FIG. 4 shows a front plan view of the bin of the present invention.
Figure 6:
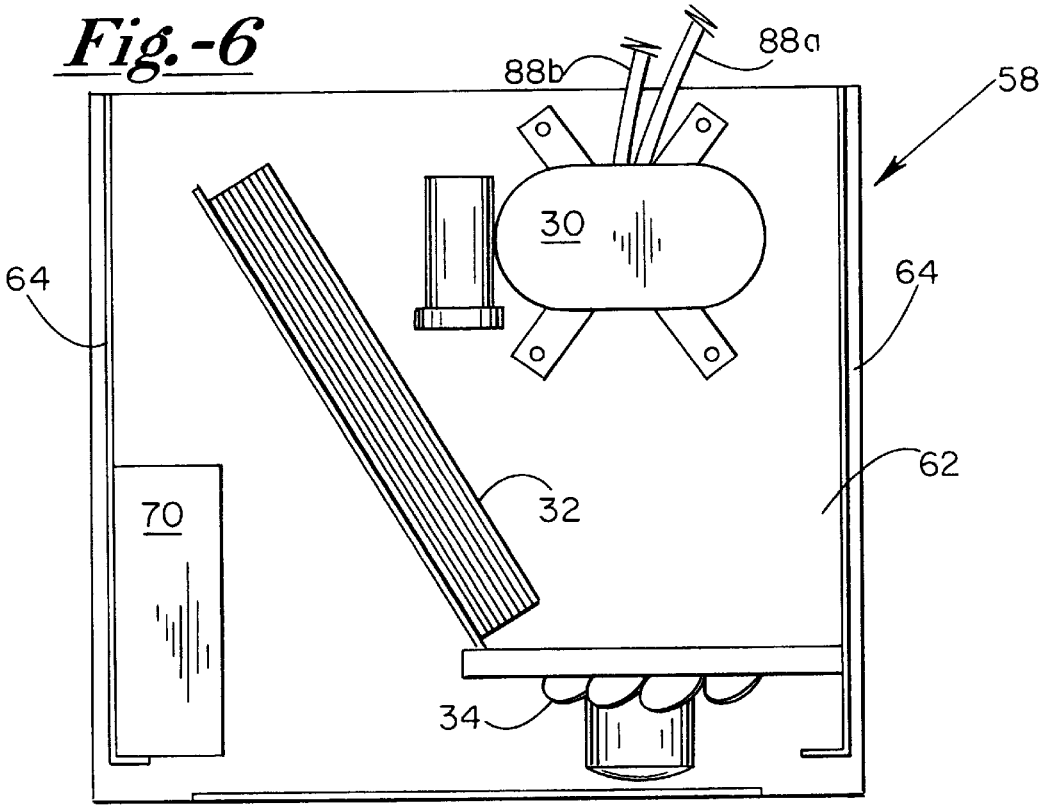
FIG. 6 shows a top plan view of the refrigeration base.
Figure 7:
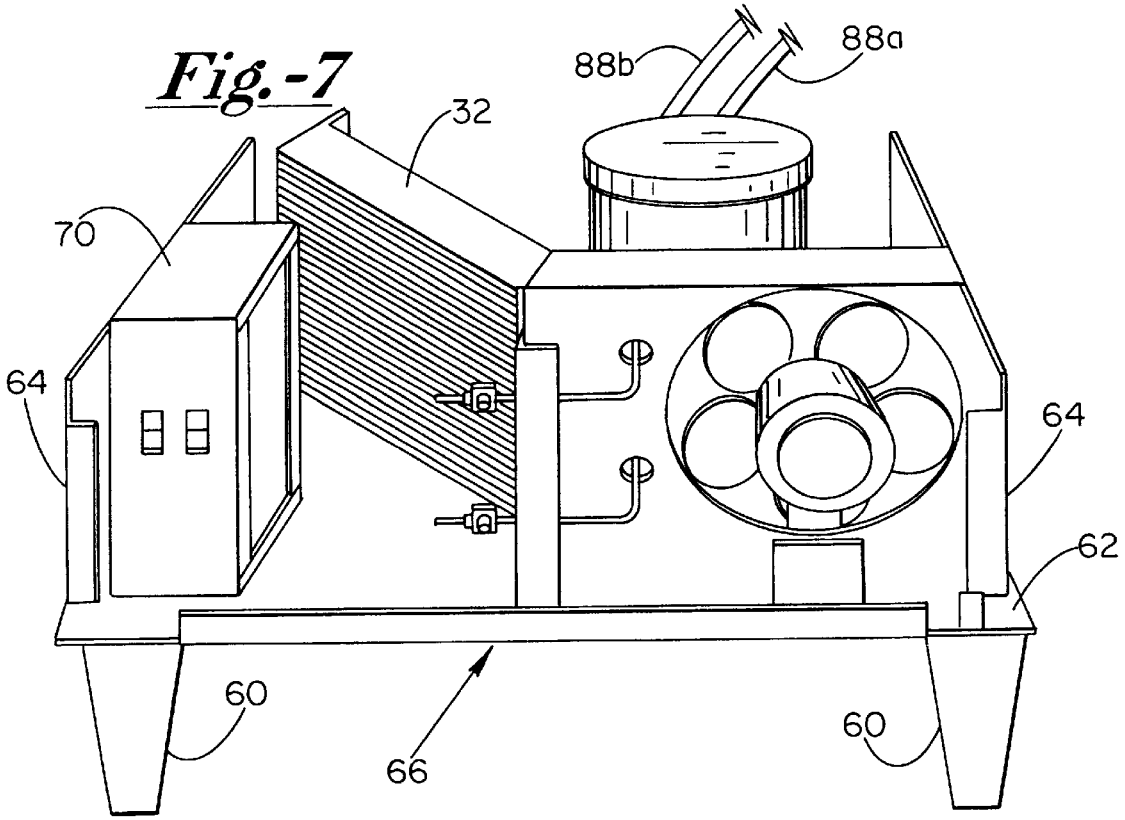
FIG. 7 shows a front side plan view of the base along lines 7—7 of FIG. 6.
Figure 8:
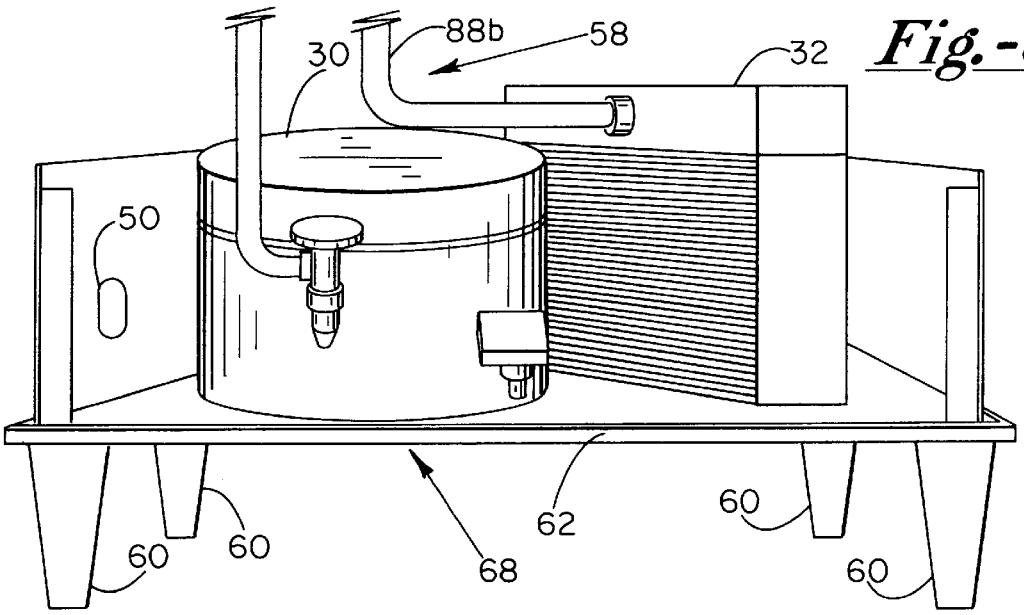
FIG. 8 shows a rear side plan view of the base along lines 8—8 of FIG. 6.

A better understanding of the actual positioning of the above discussed refrigeration and water system components can be had by referring to FIGS. 6–11. As seen specifically in FIGS. 6–8, a base 58 includes four legs 60 secured to and extending from a horizontal support plate or panel 62. The condenser 32 is secured to plate 62 at an angular orientation and condenser cooling fan 34 is positioned adjacent condenser 32, and compressor 30 is also secured to plate 62. Flanges 64 provide for securing to legs 28 for securing bin 12 to base 58. When secured thereto, a front access area 66 and a rear acces area 68. Respectively, are created. Front access panel 66*a* and a rear panel, not shown, are releasably securable to bin 12 and base 58 over access areas 66 and 68. Panel 66*a* comprises a screen that permits air flow created by fan 34, as indicated by the arrows of FIG. 6, to flow there through. When panel 66*a* is removed, as seen in FIG. 2, it can be appreciated that fan 34 and a control box 70 are accessible for service checking, repair or replacement. Control box 70 houses the electronic components of control 55. When the rear panel is removed, valves 38, 40 and 50 are likewise accessible for repair or replacement. In addition, service valves 52*a* and 52*b* are also conveniently positioned adjacent front access area 66. Thus, the present invention provides for easy access to the majority of the refrigeration components and to the control electronics without necessitating the removal of bin 12 from base 58.

Figure 9:
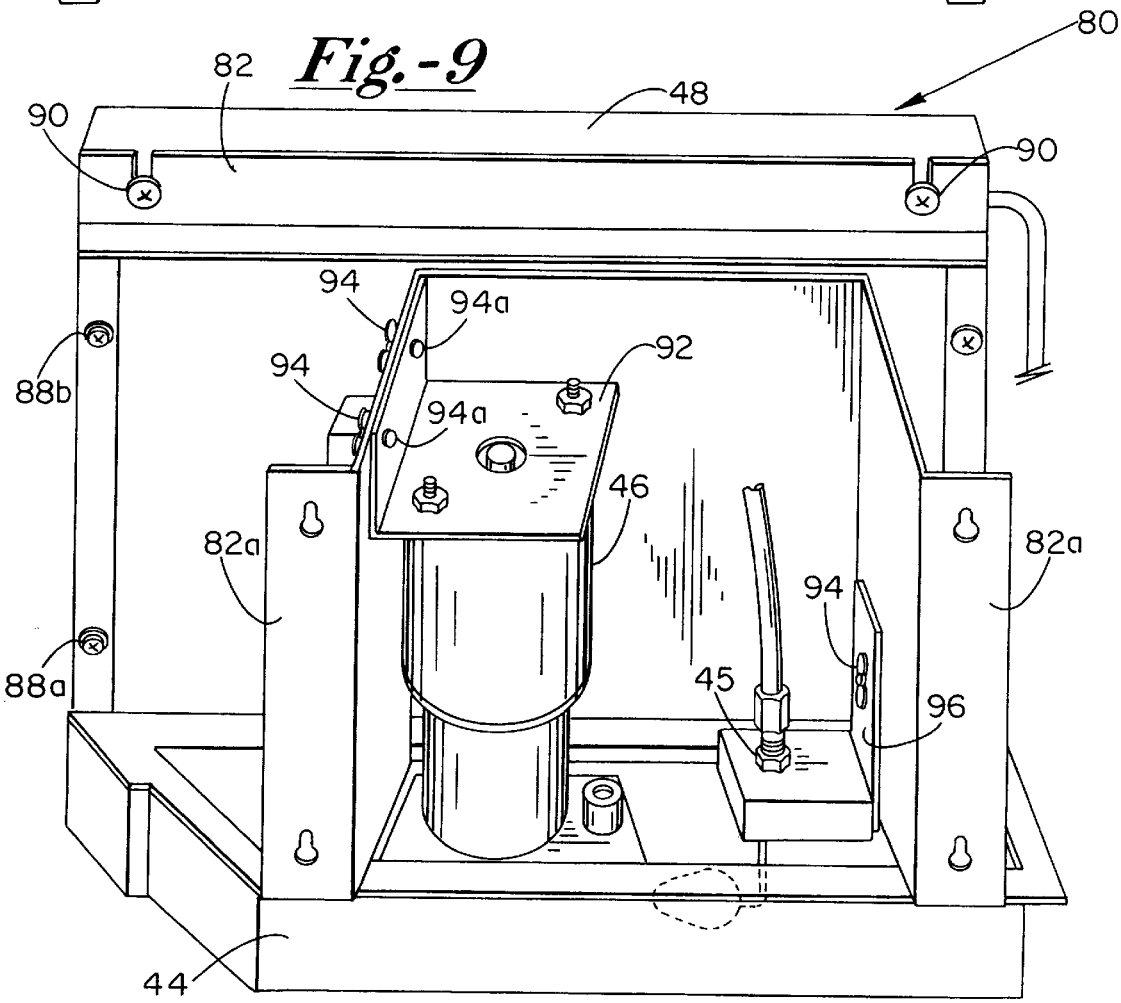
FIG. 9 shows an enlarged rear perspective view of the evaporator assembly.
Figure 10:
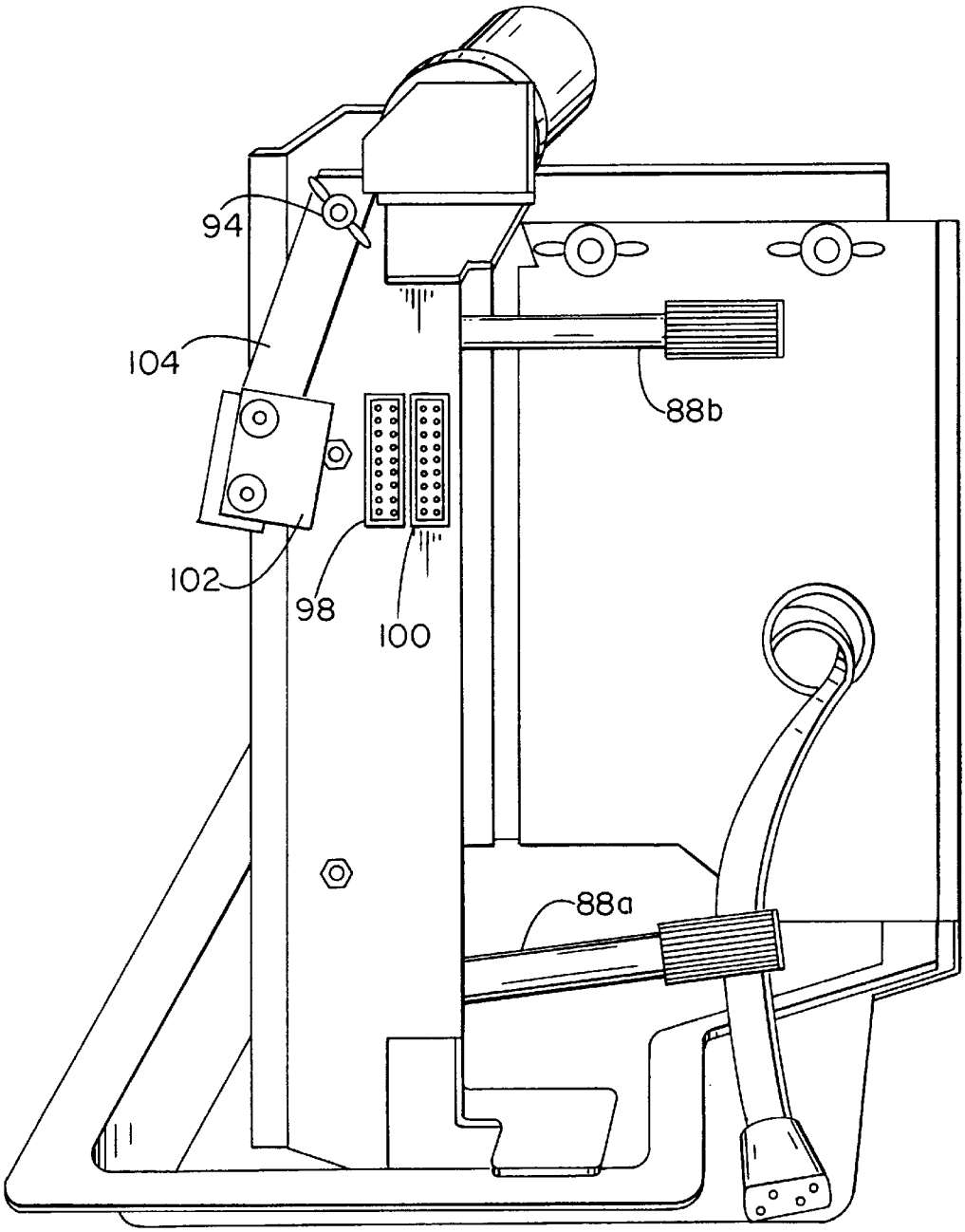
FIG. 10 shows an end plan view of the evaporator assembly along lines 10—10 of FIG. 9.
Figure 11:
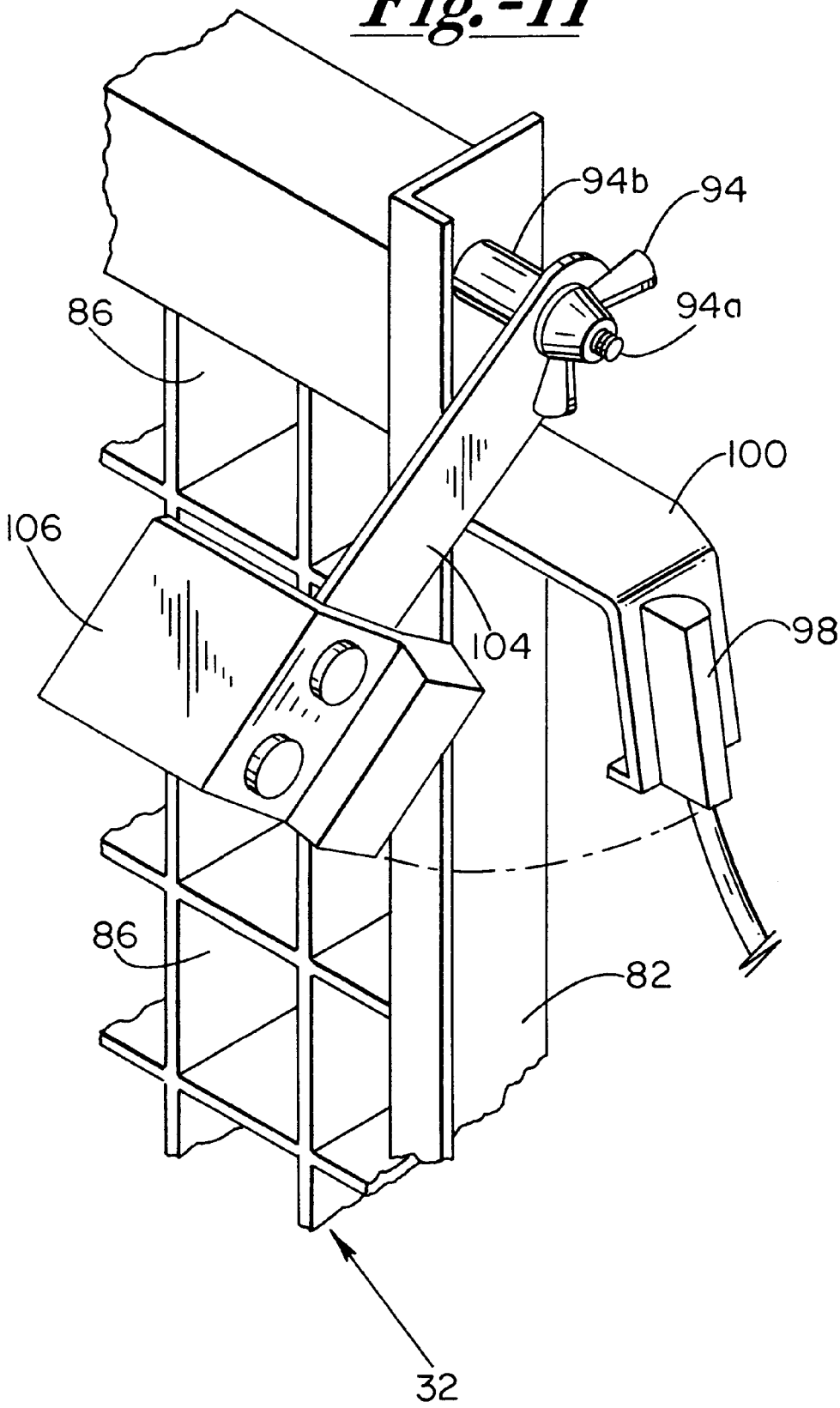
FIG. 11 shows a further enlarged plan view along lines 11—11 of FIG. 10.

As seen by referring to FIGS. 9–11, an evaporator assembly 80 is shown. Assembly 80 includes a frame 82 having a pair of L-shaped flanges 82*a* for securing assembly 80 to an upper rear wall portion 84 of bin 12 within interior area 15. Evaporator 36 includes a plurality of ice cube forming sites 86 and is secured to frame 82. Refrigerant lines 88*a* and 88*b* extend from compressor 30 and expansion valve 38 respectively, and are connected to evaporator 36. Line 88*a* and 88*b* extend within recess area 20. Lines 88*a* and 88*b* extend through slot 27 to provide fluid connection to evaporator 36. Water distribution tube 48 is releasably secured to frame 82 by a pair of thumb screws 90. Tray 44 is also secured to frame 82, and pump 46 is secured to a flange 92. Flange 92 is releasably secured to an L-shaped support flange 82*a* by a pair of wing nuts 94 and bolts 94*a*. Inlet valve 45 is secured to a further support flange 96, also secured to an L-shaped support flange by a further wing nut 94 and bolt 94*a*.

As seen in FIGS. 10 and 11, an ice drop or harvest sensing mechanism is shown and includes a proximity sensor 98 secured to a flange 100 and a magnet 102 secured to a further flange 104. Flanges 100 and 104 are secured to frame 82 by a wing nut 94 and bolt 94*a*. However flange 104 is pivotally secured thereto, thereby moving through an arc as indicated by the dashed outline thereof Flange 104 includes an ice contact portion 106 normally positioned close to the surface of evaporator 36 wherein magnet 102 is in contact with switch 98.

The present invention operates to manufacture ice cubes whereby water, delivered to tray 44 by inlet valve 42, is pumped from tray 44 by pump 46 to water distribution tube 48. Water is distributed thereby to run in and over the individual ice producing pockets 86. As in known in the art, operation of the refrigeration system serves to cool evaporator 36 so that ice forms and gradually accumulates thereon. The excess water flows to, and is caught by, tray 44. When ice is sufficiently thick to harvest, such is indicated by temperature sensor 54*b*. Control 55 then stops pump 46 and operates defrost valve 40 to warm evaporator 36 sufficiently to allow the accumulated ice to release therefrom and fall into the ice retaining portion of bin 12. As the ice falls, a small portion thereof will contact portion 106 of flange 104 resulting in magnet 102 moving away from sensor 98 thereby indicating to control 55 that a further ice making cycle can be started as a successful ice harvest cycle has occurred and is completed.

Figure 12:
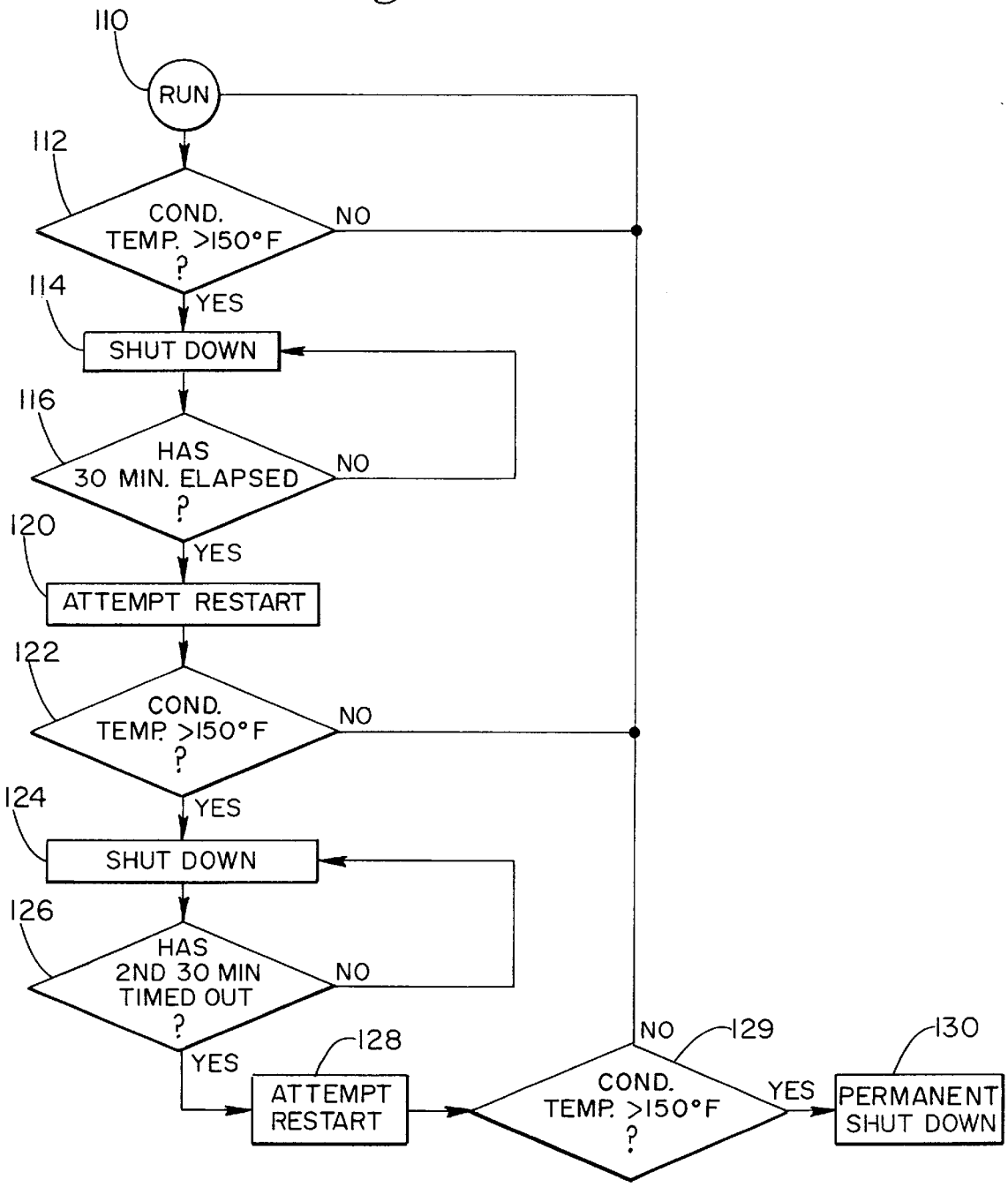
FIG. 12 shows a flow diagram of a control strategy of the present invention.

Control 55 also includes further control features as will be better understood by reference to the flow diagrams of FIGS. 12–15. As seen in FIG. 12, a high condenser temperture control routine is shown. As ice maker 10 is running, as indicated by block 110, sensor 54 is being monitored. If, at block 112, the temperature sensed thereby is below a pre-selected temperature, such as 150 degrees Fahrenheit, then normal operation is continued. If however, the sensed temperature goes above the pre-selected temperature, ice maker 10 is put into a shut down mode at block 114. However, at block 116, a pre-selected timer is set, for example 30 minutes, and when it times out a restart is attempted at block 120. If during restart the condenser temperature again exceeds the pre-selected condenser high temperature, block 122, ice maker 10 is returned to shut down mode, block 124. If however, the condenser temperature is below the temperature maximum, normal ice making cycling is resumed. At block 126, a second 30 minute timer is initiated. When the second 30 minute timer times out, a second restart is attempted at block 128. Again, if the condenser temperature, at block 129 stays below the pre-selected temperature, normal ice making is resumed. If however, that temperature again exceeds the critical temperature, ice maker 10 is put into permanent shut down, at block 130. Thus, if after two tries to restart after the initial shut down, no further attempts to restart are initiated and the control requires a manual restart. This high condenser temperature routine is of value, where the reason for the high temperature is transitory. Such can occur where, for example, some object has temporarily blocked air flow through panel 66*a*. By allowing ice maker 10 one or more restarts after a timing interval, there is an opportunity for normal operation to resume where the air flow blockage has been removed. In this manner, a service call and the cost thereof, can be avoided.

Figure 13:
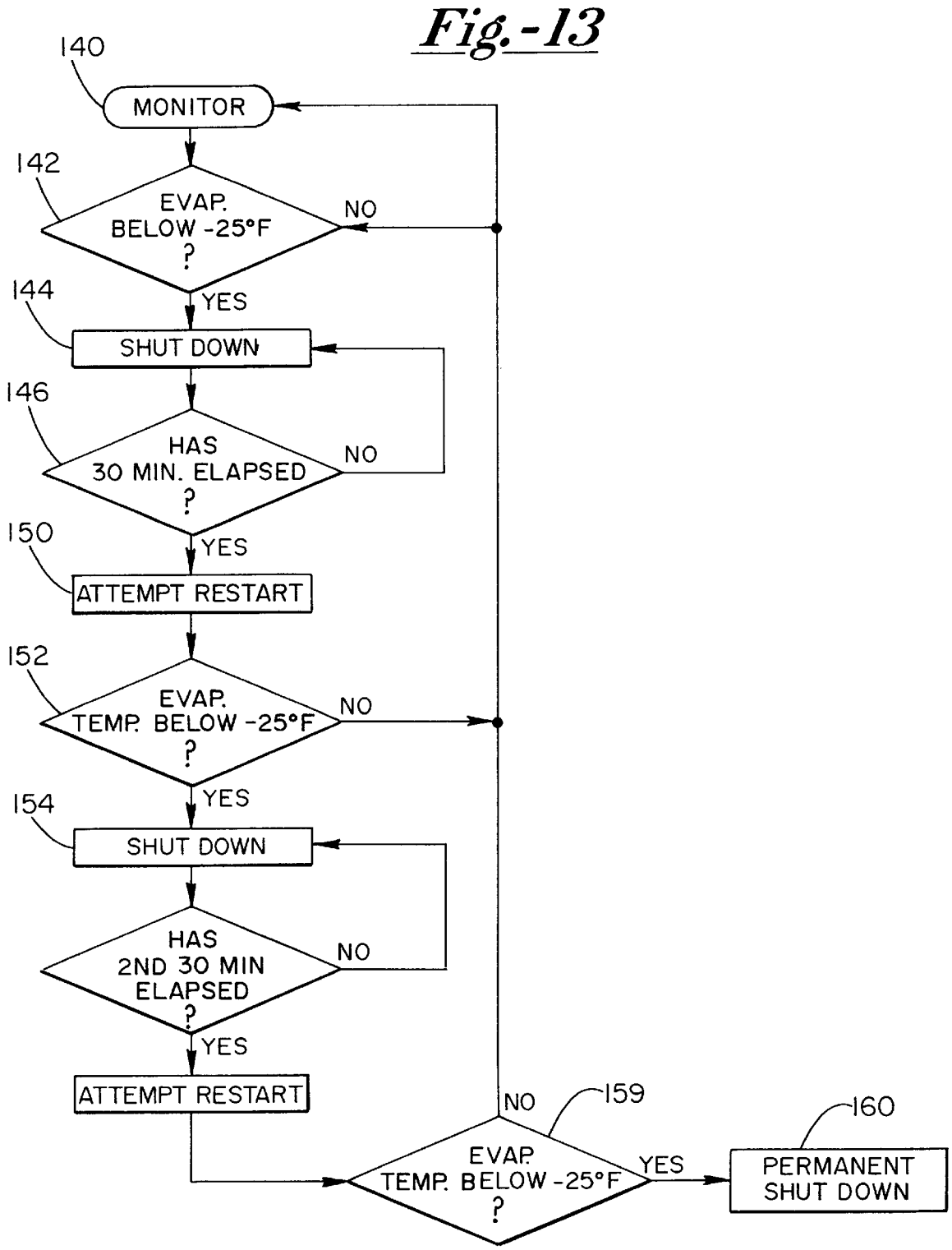
FIG. 13 shows a further flow diagram of a control strategy of the present invention.

As seen in FIG. 13, a low evaporator temperture control routine is shown. As ice maker 10 is running, as indicated by block 140, sensor 54*b* is being monitored. If, at block 142, the temperature sensed thereby is above a pre-selected temperature, such as minus 25 degrees Fahrenheit, then normal operation is continued. If however, the sensed temperature reaches or goes below the pre-selected temperature, ice maker 10 is put into a shut down mode at block 144. However, at block 146, a pre-selected timer is set, for example 30 minutes, and when it times out, a restart is attempted at block 150. If during restart the evaporator temperature again reaches or goes below the pre-selected evaporator minimum operating temperature, block 152, ice maker 10 is returned to shut down mode, block 154. If however, the evaporator temperature is above the temperature minimum, normal ice making cycling is resumed. At block 156, a second 30 minute timer is initiated. When the second 30 minute timer times out, a second restart is attempted at block 158. Again, if the evaporator temperature, at block 159 stays above the pre-selected temperature, normal ice making is resumed. If however, that temperature again reaches or goes below the critical temperature, ice maker 10 is put into permanent shut down, at block 160. Thus, if after two tries to restart after the initial shut down, no further attempts to restart are initiated and the control requires a manual restart. This low evaporator temperature routine is of value, where the reason for the low temperature, is transitory. Such can occur where, for example, no water is available for circulation over the evaporator as the result of a temporary water shut down. By allowing ice maker 10 one or more restarts after a timing interval, there is an opportunity for normal operation to resume where, for example, water that has been shut off for some repair purpose is turned back on after such repair has been completed. In this manner, a service call and the cost thereof, can be avoided.

Figure 14:
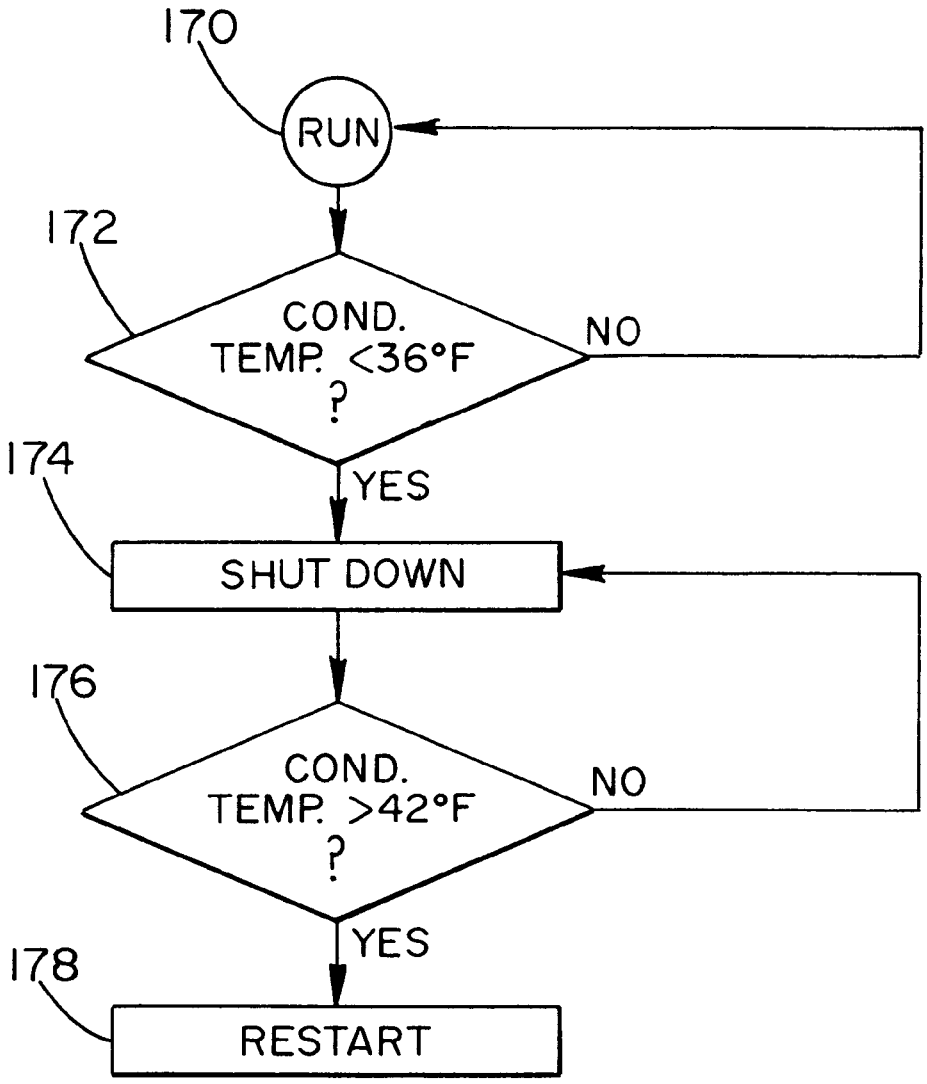
FIG. 14 shows a further flow diagram of a control strategy of the present invention.

As seen in FIG. 14, a low condenser temperture control routine is shown. As ice maker 10 is running, as indicated by block 170, sensor 54*a* is being monitored. If, at block 172, the temperature sensed thereby is above a pre-selected temperature, such as 36 degrees Fahrenheit, then normal operation is continued. If however, the sensed temperature goes below the pre-selected temperature, ice maker 10 is put into a shut down mode at block 174. At block 176 the condenser temperature is continually monitored, and if that temperature goes above a further pre-selected temperature, such as 42 degrees Fahrenheit, ice maker 10 can be restarted, block 178, into a normal ice making cycle. This low condenser temperature routine is of value, where the reason for the low temperature, is transitory. Such can occur where, for example, the ambient temperature is too low. Thus, where the ambient temperature rises to a sufficient temperature, ice making can again proceed. In this manner as well, a service call and the cost thereof, can be avoided.

Figure 15:
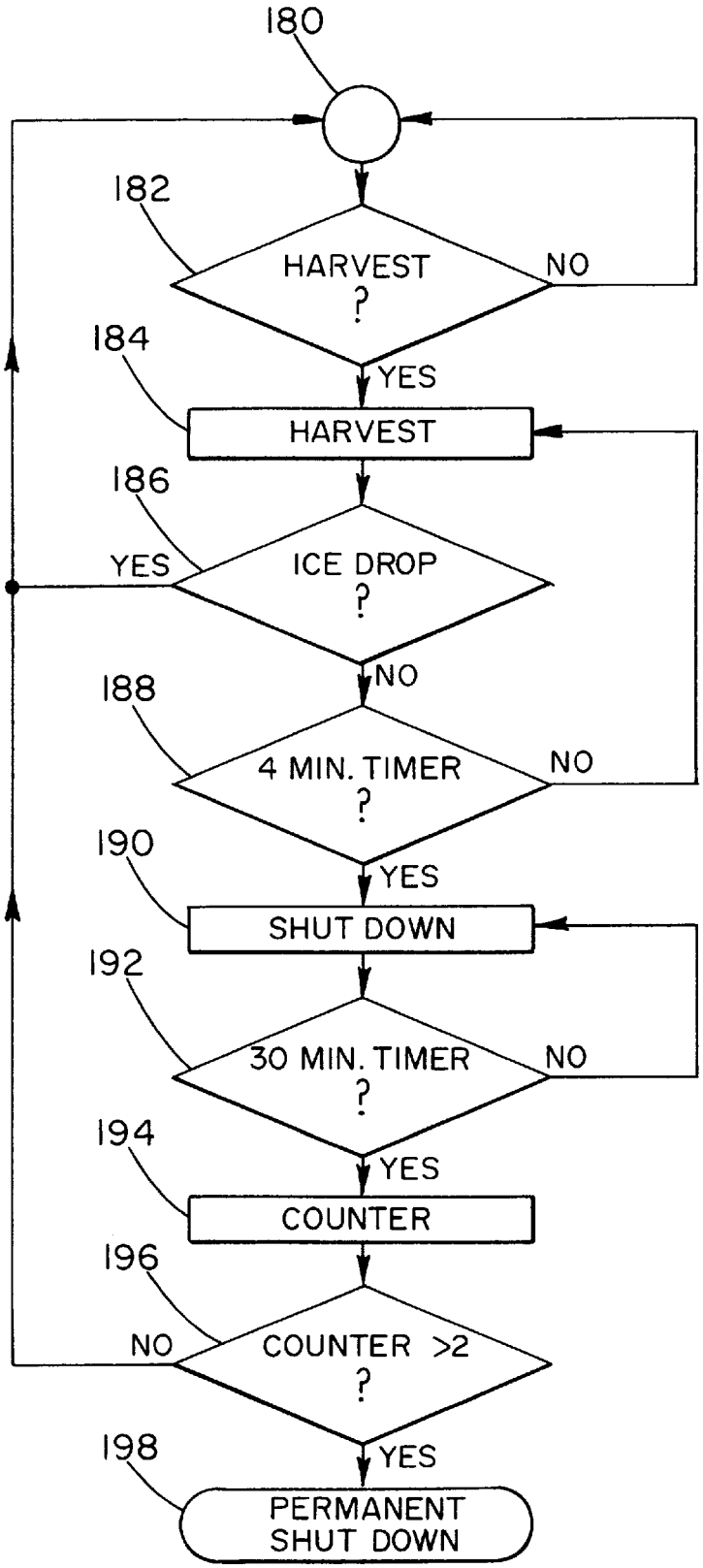
FIG. 15 shows a further flow diagram of a control strategy of the present invention.

As seen in FIG. 15, an ice harvest control routine is shown. As ice maker 10 is running, as indicated by block 180, sensor 54*b* is being monitored. If, at block 182, the temperature sensed thereby reaches a pre-selected temperature, such as 6 degrees Fahrenheit, sufficient ice is indicated to have formed on evaporator 36, harvest is initiated at block 184. During the harvest cycle proximity switch 98 is monitored, at block 186, to see if magnet 102 moves away therefrom indicating completion of a successful harvest. If switch 98 so indicates, then a subsequent ice making sequence is started, block 188. If switch 98 does not indicate harvest a first four minute timer is initiated at block 190. If the first four minute timer has not elapsed, the harvest cycle continues. If the first four minute timer has elapsed, a harvest stop is initiated at block 192 and a new ice forming cycle is initiated at block 194. When a subsequent harvest initiation is required at block 196 a second harvest is initiated at block 198. Switch 98 is again monitored at block 200 and if that switch indicates that ice has been harvested, a subsequent ice making sequence is initiated at block 188. However, if ice has not fallen, a second four minute timer is initiated at block 202. In this case, if the second four minute period times out before switch 98 indicates a successful harvest, ice maker 10 is put into a permanent shut down, block 204. Thus, the control herein provides for one additional attempt to harvest ice after an intervening ice making routine. Failure to drop ice can occur for a variety of transient reasons that are not due to a component failure of ice maker 10. Thus, by allowing ice maker two attempts at harvest, there is an opportunity for normal operation to resume. In this manner, a service call and the cost thereof, can also be avoided.

What is claimed is:

1. An under counter ice maker, comprising:

a unitary molded bin defining and interior space defined by opposing front an back walls and opposing side walls extending upward from a bottom end and enclosed by a top panel and an ice access door, and the interior space having an upper ice making mechanism area and a lower ice retaining area, and the bin secured to a base unit, the base unit for retaining refrigeration components for cooling an evaporator, the evaporator forming a part of the ice making mechanism and the evaporator connected to the refrigeration components by refrigerant lines, and the back wall defining a vertical concave portion therein and a vertical panel secured there over for forming a protected vertical channel through which the refrigerant lines extend between the evaporator and the refrigeration components.

2. The ice maker as defined an claim 1, and the back wall having a slot formed in the concave portion thereof for facilitating extension of the refrigerant lines into the upper ice making mechanism area.

* * * * *